US008714259B2

(12) United States Patent
Orban et al.

(10) Patent No.: US 8,714,259 B2
(45) Date of Patent: May 6, 2014

(54) APPARATUS AND METHODS FOR WELL-BORE WALL SURFACE FINISHING

(75) Inventors: Jacques Orban, Cheltenham (GB); Claude Vercaemer, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 177 days.

(21) Appl. No.: 12/744,344

(22) PCT Filed: Nov. 20, 2008

(86) PCT No.: PCT/EP2008/009836

§ 371 (c)(1),
(2), (4) Date: Aug. 30, 2010

(87) PCT Pub. No.: WO2009/065588

PCT Pub. Date: May 28, 2009

(65) Prior Publication Data

US 2010/0314119 A1 Dec. 16, 2010

(30) Foreign Application Priority Data

Nov. 23, 2007 (GB) ..... 0722929.7

(51) Int. Cl.
*E21B 37/00* (2006.01)
*E21B 37/02* (2006.01)

(52) U.S. Cl.
USPC ..... 166/311; 166/170

(58) Field of Classification Search
USPC ..... 166/311, 170, 177.3; 175/92, 95, 291, 175/263, 406, 408
See application file for complete search history.

(56) References Cited

U.S. PATENT DOCUMENTS

| | | | | | |
|---|---|---|---|---|---|
| 1,361,304 | A | | 12/1920 | Bryon | |
| 1,906,427 | A | * | 5/1933 | Sievers et al. | 175/292 |
| 2,166,937 | A | * | 7/1939 | Bettis | 175/325.5 |
| 2,495,073 | A | * | 1/1950 | Morris | 175/401 |
| 2,497,990 | A | * | 2/1950 | Huber et al. | 33/544.3 |
| 2,499,916 | A | * | 3/1950 | Harris | 175/267 |
| 2,695,771 | A | * | 11/1954 | Salvatori et al. | 175/346 |

(Continued)

FOREIGN PATENT DOCUMENTS

| | | |
|---|---|---|
| EP | 1592097 | 11/2005 |
| EP | 1041683 | 1/2006 |

(Continued)

OTHER PUBLICATIONS

International Search Report for the equivalent PCT patent application No. PCT/US2009/066336 issued on Feb. 19, 2010.

*Primary Examiner* — Daniel P Stephenson
(74) *Attorney, Agent, or Firm* — Stephanie Chi; Jody DeStefanis

(57) ABSTRACT

An apparatus for modifying the wall surface of a borehole drilled through an underground formation. The apparatus comprises a tool body that can be introduced into the borehole using a conveyance system so as to be moveable along the borehole, and one or more members arranged so as to be able to be urged against, and moved across at least part of the borehole wall in order to work the surface thereof and modify its properties. A method of modifying the wall surface comprises positioning the tool body in the borehole at a location of interest using the conveyance system, urging the members against the borehole wall with sufficient force to modify the properties of the surface thereof, and moving the members across the surface of the borehole wall.

22 Claims, 4 Drawing Sheets

(56) References Cited

U.S. PATENT DOCUMENTS

| | | | | |
|---|---|---|---|---|
| 2,776,111 | A * | 1/1957 | Vance | 175/325.5 |
| 2,776,112 | A | 1/1957 | Ilfrey et al. | |
| 4,552,232 | A * | 11/1985 | Frear | 175/337 |
| 4,765,417 | A * | 8/1988 | Perkin et al. | 175/347 |
| 5,381,868 | A * | 1/1995 | Schock | 175/346 |
| 5,649,603 | A * | 7/1997 | Simpson et al. | 175/323 |
| 6,968,897 | B2 * | 11/2005 | Doyle et al. | 166/214 |
| 7,000,713 | B2 * | 2/2006 | Crooks | 175/406 |
| 7,182,025 | B2 * | 2/2007 | Ghorbel et al. | 104/139 |
| 2004/0045741 | A1 * | 3/2004 | Tessari et al. | 175/57 |
| 2005/0217861 | A1 * | 10/2005 | Misselbrook | 166/373 |
| 2005/0263325 | A1 * | 12/2005 | Doering et al. | 175/106 |
| 2006/0134995 | A1 | 6/2006 | Bolouri-Saransar et al. | |
| 2010/0319998 | A1 * | 12/2010 | Cooper et al. | 175/90 |
| 2013/0068479 | A1 * | 3/2013 | AlDossary | 166/381 |

FOREIGN PATENT DOCUMENTS

| | | |
|---|---|---|
| GB | 2195378 | 4/1998 |
| GB | 2396365 | 6/2004 |
| GB | 2418212 | 3/2006 |
| SU | 909121 | 2/1982 |
| SU | 1361304 | 12/1987 |
| WO | 2004/057151 | 7/2004 |

* cited by examiner

APPARATUS AND METHODS FOR WELL-BORE WALL SURFACE FINISHING

CROSS-REFERENCE TO RELATED APPLICATIONS

The present application is based on and claims priority to GB Application No. 0722929.7, filed 23 Nov. 2007; and International Patent Application No. PCT/EP2008/009836, filed 20 Nov. 2008. The entire contents of each are herein incorporated by reference.

TECHNICAL FIELD

This invention relates to apparatus and methods for providing a surface finishing action for the walls of a borehole drilled in an underground formation. In particular, the invention relates to such methods and apparatus for use in boreholes such as oil and gas wells.

BACKGROUND ART

When extracting oil and gas from underground formations, boreholes are drilled through the underground formations until the oil or gas bearing strata are reached. The techniques for drilling such boreholes are well-known and typically involve the use of a drilling fluid both to assist in the drilling action and removal of drilled cuttings, and in the stabilization of the borehole by hydrostatic pressure and formation of a mud cake around the surface of the borehole in porous formations.

There are a number of issues relating to the wall quality of the borehole. Equipment sticking is one major issue that occurs regularly in various wells. This problem may occur with drilling equipment, wireline tools and cable, casing and completion equipment, etc. Various causes of sticking exist, the most common being "differential sticking". In this situation, sticking is due to a combination of differential pressure between the well-bore and formation and poor quality of the mud cake. Differential sticking occurs often when the mud cake is fragile, thick, and unconsolidated.

With wireline equipment, differential sticking may also occur on the cable itself when the equipment is in static condition (for example during the pressure testing of the formation). Sticking is acerbated by the fact that the cable can cut through the mud cake during running in and out of the well.

Other reasons for equipment sticking (especially while tripping-out of the well) is geometrical irregularity of the well such as ledges, key seats, etc. It is not always easy to detect the presence of these irregularities and to smooth them out by "machining" effect of the drill-bit when drilling the borehole. Thus they can remain even after the well has been drilled.

Ensuring proper sealing between the well-bore and the formation is critical not only to reduce the risk of sticking but also for limiting the mud loss. With high porosity and permeable formations at low pressure, mud loss control may depend also of the quality of the interface and mud cake. In some situations, these qualities are not achieved and mud loss may be difficult to control. Mud loss in highly fractured rock (of low pressure) may be also difficult to control with either loss circulation material mixed within the drilling mud, or by special fluids (or pastes) such as cement and polymer injected at the best estimated position.

In other cases, the quality of the cement job used to line the borehole may not be optimum to ensure proper zone isolation. A number of reasons for this may exist. Well-bore irregularities such as wash-outs may make mud removal prior to cement placement difficult. Thick and soft mud cake may also be part of the problem for lack of zone isolation as it can create "mud channels" left parallel to the well axis. Improper formation sealing by mud cake also increases the risk of gas channeling during cement setting. These channels may create leakage paths between zones. Even with current technology, problems with zone isolation can be difficult to detect and repair.

Current drilling practices may also contribute to well-bore irregularity may. For example:

- High flow rates may generate wash-outs in weak formations.
- Hole enlargement may be provoked by aggressive drilling (drill-string resonance, BHA whirling, and the like).
- A succession of dog-legs (with occasional ledges) can be created when drilling with steerable motors.
- Rough surfaces can be obtained when drilling with steerable motors in rotary mode.

These hole conditions affect friction between devices (drill-sting, casing, etc.) in the hole and the bore-hole. In some case, drilling string or casing string cannot move downwards to too high friction, Wireline logging may also be of low quality due to these wall problems.

There have been a number of proposals for dealing with borehole wall quality during drilling. Examples can be found in WO 2004/057151, U.S. Pat. No. 2,776,111 and SU 1 361 304.

DISCLOSURE OF INVENTION

A first aspect of the invention provides an apparatus for modifying the wall surface of a borehole drilled through an underground formation, comprising:

- a tool body that can be introduced into the borehole using a conveyance system so as to be moveable along the borehole; and
- one or more members arranged so as to be able to be urged against, and moved across at least part of the borehole wall in order to work the surface thereof and modify its properties.

The conveyance system is preferably a cable or flexible tube.

The members preferably comprise an array of rollers that can be pressed against the borehole wall. The rollers can be mounted on arms extending from the tool body and by which the force pressing them against the wall can be applied and controlled. The arms can be operable so as to hold the tool body substantially centrally on the borehole axis when the rollers are pressed against the wall.

In one embodiment, the rollers are passive, relative movement of the tool body to the wall causing them to roll when in contact with the wall. In another embodiment, the rollers are driven so as to rotate when in contact with the wall. In a preferred embodiment, the rollers are driven to rotate at a faster rate than that caused by relative movement of the tool body to the borehole wall. The rollers can also include formations on their surfaces to enhance a grinding effect as they roll over the borehole wall.

The rollers can be arranged with their axes perpendicular to the borehole axis. In this case, the rollers are preferably narrower at the ends than in the middle so as to accommodate curvature of the borehole wall. A plurality of rollers can be arranged around the tool body so as to provide coverage of substantially all of the circumference of the borehole wall. To achieve this, the rollers may be disposed radially around the tool body and axially on the tool body. The rollers may overlap in the circumferential direction when in contact with the wall. When the rollers are powered, they may act to move the tool body along the borehole.

Alternatively, the rollers may be arranged with their axes parallel to the borehole axis. In this case, means are provided to rotate the array of rollers around the tool axis so as to provide full circumferential coverage. These means can comprise means for rotating the tool body with the array fixed thereto, or means for rotating the array on the tool body. In a variant of this embodiment, the roller axes are at an angle to the borehole axis so as to accommodate or encourage axial movement of the apparatus in the borehole as the array rotates.

In a further embodiment of the invention, means are provided for injecting a treatment fluid in front of the rollers as they are moved over the borehole wall.

A second aspect of the invention provides a method of modifying the wall surface of a borehole drilled through an underground formation using an apparatus according to the first aspect of the invention, comprising:

- positioning the tool body in the borehole at a location of interest using the conveyance system;
- urging the members against the borehole wall with sufficient force to modify the properties of the surface thereof; and
- moving the members across the surface of the borehole wall.

Where the members comprise an array of rollers, the method can include creating a relative movement between the array and the borehole wall such that the rollers roll over its surface. The relative movement can comprise movement along the borehole axis and/or rotation of the array about the borehole axis.

Further aspects of the invention will be apparent from the description below.

BRIEF DESCRIPTION OF FIGURES IN THE DRAWINGS

BEST MODE FOR CARRYING OUT THE INVENTION

Figure 1:
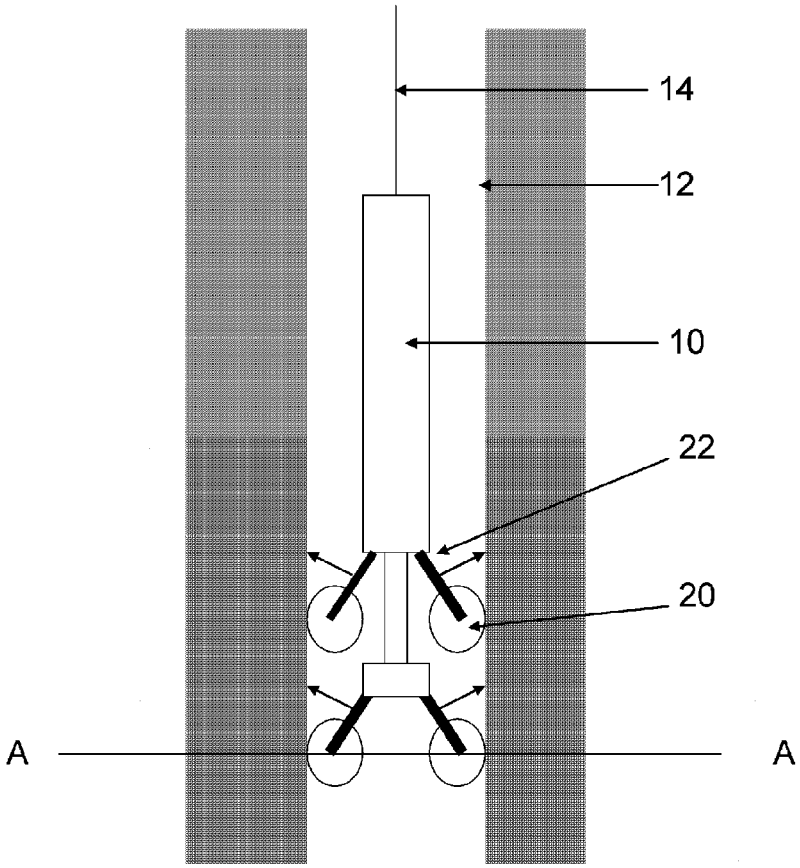
FIG. 1 shows a side view of a tool according to a first embodiment of the invention.
Figure 2:
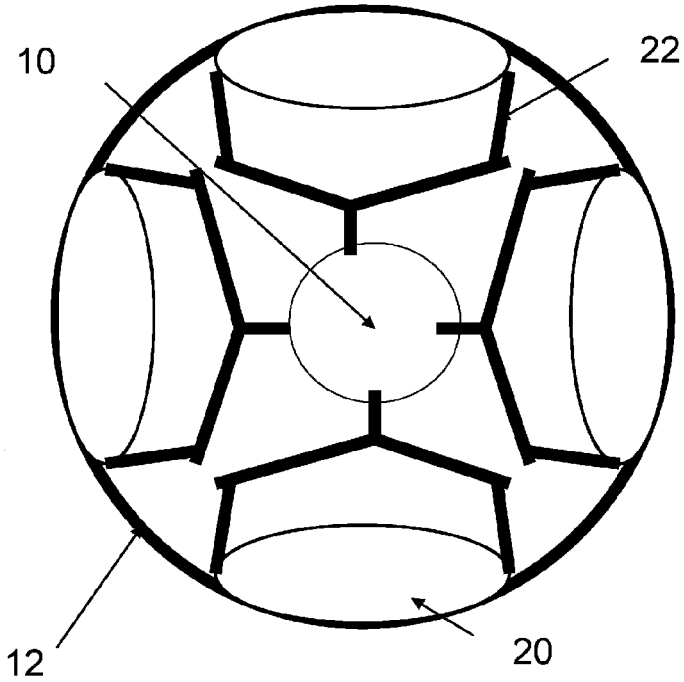
FIG. 2 shows an axial view of the tool of FIG. 1 at level A-A.

One embodiment of the invention is shown in FIGS. 1 and 2. This comprises a tool body 10 that is suspended in a well 12 by means of a wireline cable 14. At the lower end of the body are two sets of rollers 16, 18. Each set comprises four rollers 20, each mounted on an arm 22 and arranged at 90° around the tool axis. The rollers of set 16 can be offset from those of the other 18 by 45°. The arms 22 are operable to push the rollers 20 out from the tool axis against the wall of the borehole 12. The axis of the rollers 20 is perpendicular to the axis of the borehole 12 (and tool body 10), so that the rollers 20 act as "wheels" pressed against the wall. While two sets of four rollers are shown here, other numbers can be used provided that there are sufficient rollers to cover substantially the full circumference of the hole 12. The rollers 20 are not cylindrical but have a curved surface so as to be narrower at that ends than in the middle. This helps to ensure good contact with the wall despite the well-bore curvature. Due to this variation of the roller diameter over the length of the roller, the roller surface does not have the same linear velocity over the length of the contact: in the centre of the roller, the linear velocity is too high, whereas it is too small at the edges. This mismatch of velocity ensures extra plastering of the mud cake (working of the thixotropy) as the rollers are moved over the borehole wall to ensure its proper compaction.

Figure 3:
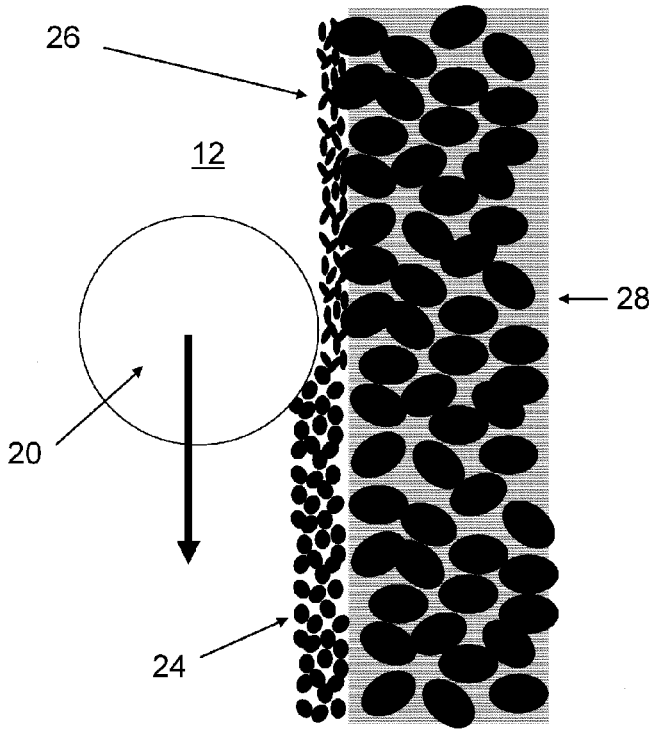
FIG. 3 shows the mud cake compaction by one of the rollers.

The purpose of the rollers 20 is to compress the mud cake 24 on the borehole wall (as is shown in FIG. 3) so that, following compression 26, the particles are compact while its fluid content is reduced. Thanks to this action, the mud cake can have better mechanical resistance while ensuring better pressure insulation between the borehole 12 and the formation 28. These effects can combine to reduce the risk of differential sticking, either during following wireline operations or further drilling.

This wireline device equipped with rollers could be run with logging tools. It is probably better to have this new device at the bottom of logging string to stabilize the mud cake before passing the logging tool.

If enough mud cake and wall compaction cannot be reached in a single pass, the tool may be moved alternatively upwards and downwards for multiple passages along the same depth interval. The application force applied to the rollers 20 by the arms 22 may be changed from passage to passage for optimum compaction.

As the rollers are pressed independently against the borehole, the tool can also act as a tool centralizer (either active or passive). With this approach, logging string could be attached to the tool and generate less drag against the mud cake when running in and logging. The roller system acts to improve the quality (compactness) of the mud cake while reducing mechanical dragging effects. These double benefits can drastically reduce the risk of sticking during logging and subsequent drilling phases.

In one form, the rollers are simply mounted for rotation on the arms and passively roll as the tool is moved along the borehole. In another embodiment, the rollers can be mechanically (motor) driven to provide axial movement of the tool. With this option, associated logging tools can be transported in a highly inclined well where gravity makes the use of wireline alone difficult, the effect being similar to that obtained with wireline tractors.

In another embodiment, the rotation speed of each roller is arranged to be different to generate slippage between the rollers and the wall. This slippage can help improve work-out of the mud cake (to reduce gel effect) and ensure optimum smoothing effect.

Figure 4:
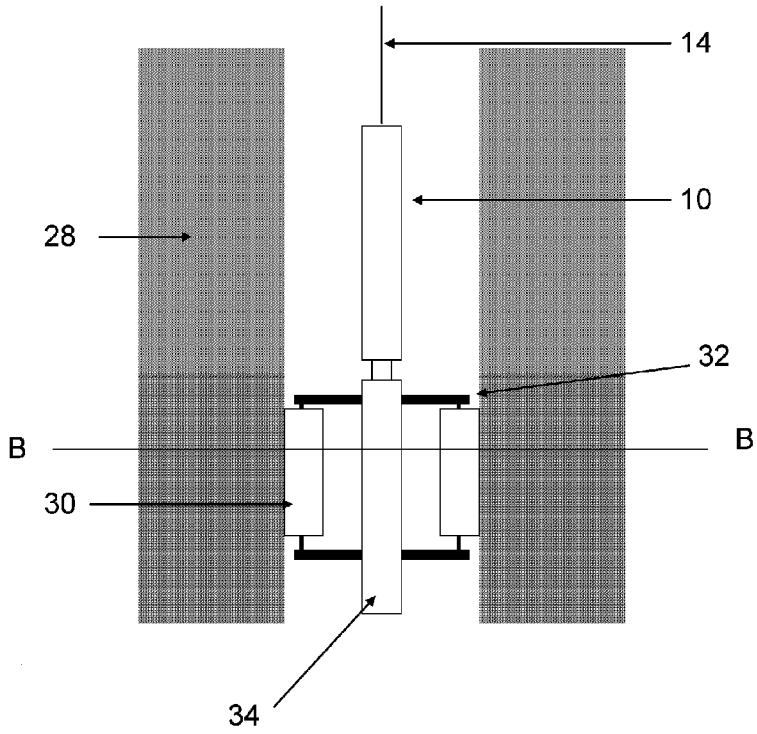
FIG. 4 shows a side view of a tool according to a second embodiment of the invention.
Figure 5:
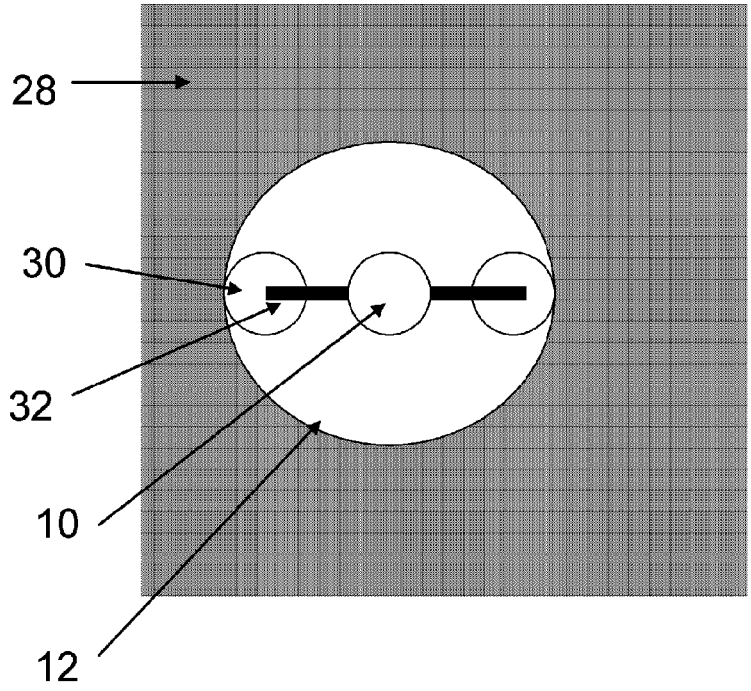
FIG. 5 shows an axial view of the tool of FIG. 4 at level B-B.

FIGS. 4 and 5 show a second embodiment of the invention. In this case, the machine has cylindrical rollers 30 mounted with their axis parallel to the bore-hole (and tool body 10) axis. The rollers 30 are mounted on arms 32 which can be opened to press them against the bore-hole wall. The arm 32 system is mounted on a rotating powered swivel 34 to rotate the rollers 32 against the wall. To provide this powered action, an electrical wireline cable is required to feed power to the tool.

With this system, the rollers 32 can make multiple turns in the hole at a given level, allowing multiple contacts with the mud cake, until proper work has been achieved to ensure proper conditioning of the mud cake and the first layer of rock near the borehole. The mud cake compaction may be optimized, while forcing fine particles into the pores of the first layer of formation to provide extra sealing for the differential pressure between the well-bore and the formation.

The axes of the rollers 32 may be slightly tilted versus the hole axis, so that the roller generate an axial pulling effect as the swivel rotates.

The rollers in both types of systems (perpendicular and axial rollers) can be pressed against the bore-hole wall. One motivation is the compaction of the mud cake. Another is the pushing of fine particles from the mud cake into the pores of the formation to decrease porosity and permeability of the surface layer of the formation. Both actions are oriented towards a better isolation of bore-hole pressure from the formation pressure.

In another embodiment, the force pushing the rollers against the formation can be modified (preferably increased) at each roller passage. Thanks to these successive actions, the mud cake can be stabilized by compaction. Then the porosity and permeability of the surface layer of the rock can be reduced first by plugging the pore by fine particles (as is described above), but finally, due to high compression force, the rock itself can be compacted to reduced directly its porosity. For the perpendicular roller tool, multiple tool passes are required.

Figure 6:
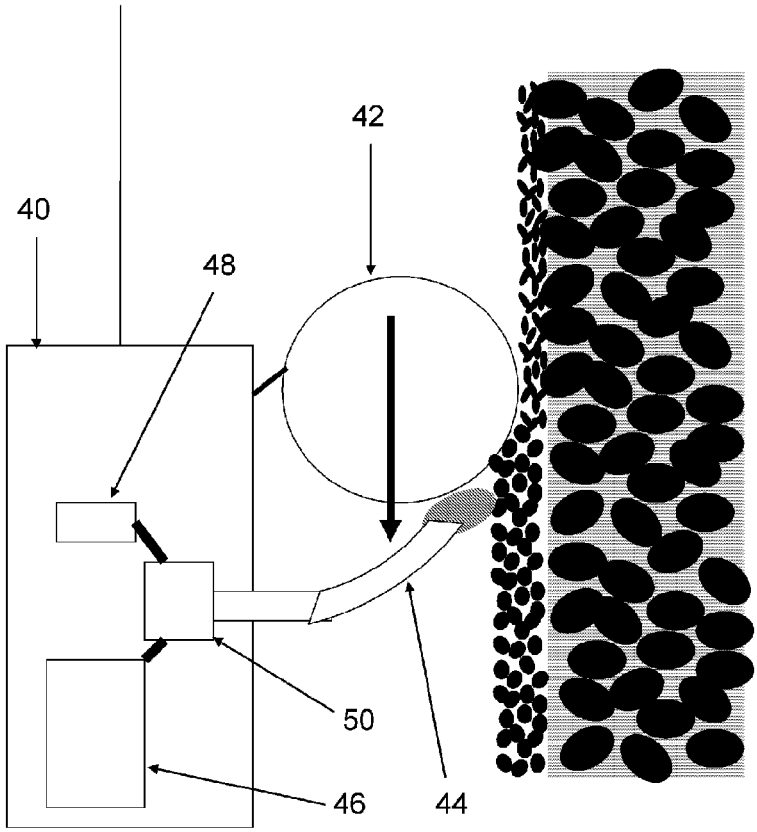
FIG. 6 shows detail of a third embodiment of the invention.

FIG. 6 shows detail of a third embodiment of the invention. In this case, fluid or paste is injected near (or at) the roller surface to improve the quality of the sealing obtained at the formation wall. This can be particularly valuable in front of zone where it is difficult to ensure good mud cake quality or where it is needed to seal fracture to avoid mud loss.

This technique can also be valuable in front of high pressure gas zones where gas channeling is expected to happen during the setting of cement.

For this application, the wireline tool 40 is equipped with means to inject fluid in the well-bore near the roller 42. In fact in the best design, the fluid can be injected at the roller surface either by fixed injecting port 44 near the roller 42, or directly by ports (and grooves) at the roller surface.

The fluid or paste is provided with an appropriate rheology and characteristics to reinforce the sealing effect. For example, for improving mud cake, the fluid may be initially quite fluid so as to be able to penetrate the pores of the rock, and then to develop thixotropy to block any additional movement. Fluids with other properties can also be considered to improve the sealing.

To be efficient, the tool may have the capability to mix fluids with some extra fluid agent (such as a catalyst) to optimize the chemical reactions just before application of the fluid at the wall. For example, the tool body 40 can include separate reservoirs of base fluid (polymer) 46 and catalyst 48, both of which feed to a mixer/dozer 50 before passing down the injection pipe 44. Such a tool allows mixing of the polymer with its reactive agent (catalyst) on demand, just before the injection of the fluid or paste at wheels. This mixing at proper proportion (on request) and control of the fluid injection requires control which can be achieved thanks the wireline communication system.

Figure 7:
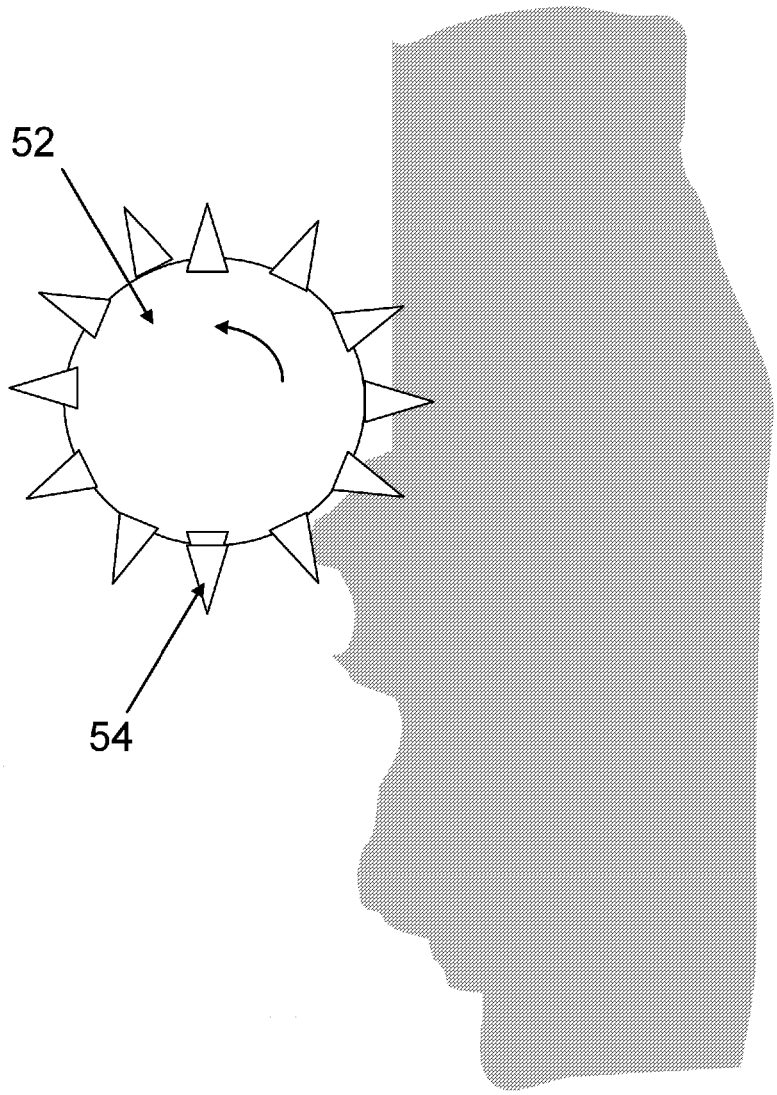
FIG. 7 shows detail of a fourth embodiment of the invention.

FIG. 7 shows another embodiment of the invention, in which the rollers 52 (from both machines: axial or perpendicular) can also be driven in rotation as grinding wheels. For this application, the application force applied by the arm is usually lowered, while the rotating velocity is high (as in a grinding wheel). The surface of the roller 52 can be reinforced to improve the grinding effect. The reinforcement can include teeth 54 (such as are found in as with roller drilling bits or PDC drilling bits). With these rollers, the hole surface finish can be improved. For this embodiment electrical wireline system can provide transmission of power (to drive the grinding wheels and the powered swivel), while ensuring proper control of contact forces, arm opening, speed of rotating devices, etc.

Spiral grooves of the type generally found at the walls of wells drilled with steerable motors can be removed using such a tool. This can improve logging quality (especially of imaging tools). It can also increase the stability of the hole, as less stress concentration will be present at the bottom of the grooves with the risk of hole collapse in highly stressed conditions such as horizontal hole. The removal of spiral grove can also reduce the friction between the drill-string or casing, allowing longer extent of the open-hole.

With this system, axial bore-hole discontinuities such as "wash-outs" can also be smoothed-out over longer lengths. Thanks to the smoother variation, stress concentrations will be lowered, reducing the risk of mechanical collapse of the hole. Furthermore, logging tool measurements can be improved by better contact of logging skids and pads against the hole.

With the tool equipped with the grinding rollers, ledges can also be machined out of the well-bore, reducing the risk of sticking while tripping out the well. Key seats can also be "machined" away to avoid sticking situations while tripping out of the hole with certain types of equipment (or drill-strings). Cement jobs can also be improved by the smoothing of the hole surface, thanks to better removal of gelled mud prior to cement placement.

Tools according to the invention can be run simultaneously with logging tools to determine the proper location for treatments as well as a means to verify the efficiency of these treatment. For this purpose, imaging tools and caliper tools are a preferred combination with the tool according to the invention.

One preferred approach is to combine multiples of these functions. The machine can have sets of normal wheels (with fluid injection ports) and other sets of wheels which are grinding devices. The grinding wheels can be activated on demand. The contact force for all the wheels can be controlled for optimum compaction (mud cake and/or rock) and wall machining.

While the present invention has been described with respect to a limited number of embodiments, those skilled in the art having the benefit of this disclosure, will appreciate numerous modifications and variations therefrom. It is intended that the appended claims cover all such modifications and variations as fall within the true spirit and scope of this present invention.

The invention claimed is:

1. An apparatus for modifying the wall surface of a borehole drilled through an underground formation, comprising:

a tool body that can be introduced into the borehole using a conveyance system so as to be moveable along the borehole;

an array of rollers arranged with their axes not parallel to the borehole axis so as to be urged against and moved across the borehole wall;

arms extending from the tool body, to which the rollers are mounted, and by which the force pressing them against the wall can be applied and controlled; and an electrical system coupled to the arms, wherein the electrical system is configured to control an extension of the arms from the tool body.

2. Apparatus as claimed in claim 1, wherein the arms are operable so as to hold the tool body substantially centrally on the borehole axis when the rollers are pressed against the wall.

3. Apparatus as claimed in claim 1, wherein the rollers are suitable for passive rotation, relative movement of the tool body to the wall causing them to roll when in contact with the wall.

4. Apparatus as claimed in claim 1, wherein the rollers are driven by the electrical system so as to rotate when in contact with the wall.

5. Apparatus as claimed in claim 4, wherein the rollers are driven to rotate at a faster rate than that caused by relative movement of the tool body to the borehole wall.

6. Apparatus as claimed in claim 4, wherein the rollers include formations on their surfaces to enhance a grinding effect as they roll over the borehole wall.

7. Apparatus as claimed in claim 1, wherein the rollers are narrower at the ends than in the middle so as to accommodate curvature of the borehole wall.

8. Apparatus as claimed in claim 1, wherein the rollers are arranged around the tool body so as to provide coverage of substantially all of the circumference of the borehole wall.

9. Apparatus as claimed in claim 8, wherein the rollers are disposed radially around the tool body and axially on the tool body.

10. Apparatus as claimed in claim 9, wherein the rollers overlap in the circumferential direction when in contact with the wall.

11. Apparatus as claimed in claim 1, wherein the rollers are powered and operable to move the tool body along the borehole.

12. Apparatus as claimed in claim 1, wherein the roller axes are at an angle to the borehole axis so as to accommodate or encourage axial movement of the apparatus in the borehole as the array rotates.

13. Apparatus as claimed in claim 1, wherein means are provided for injecting a treatment fluid in front of the rollers as they are moved over the borehole wall.

14. Apparatus as claimed in claim 1, wherein the conveyance system is a cable.

15. Apparatus as claimed in claim 1, wherein the conveyance system is a flexible tube.

16. Apparatus as claimed in claim 1, wherein:

the rollers are mounted on arms extending from the tool body and by which the force pressing them against the wall can be applied and controlled;

the rollers are driven to rotate at a faster rate than that caused by relative movement of the tool body to the borehole wall;

the rollers include formations on their surfaces to enhance a grinding effect as they roll over the borehole wall;

the rollers are narrower at the ends than in the middle so as to accommodate curvature of the borehole wall; and the rollers are disposed radially around the tool body so as to overlap in a circumferential direction when in contact with the borehole wall.

17. A method of modifying the wall surface of a borehole drilled through an underground formation, comprising:

positioning an apparatus in the borehole at a location of interest using a conveyance system, wherein the apparatus comprises a tool body, an array of rollers arranged with their axes not parallel to the borehole axis, and arms extending from the tool body, and wherein each roller is mounted to a corresponding one of the arms;

operating the arms with an electrical control system to modify a position of the arms to control a force between the rollers against the borehole wall to modify the properties of the surface thereof; and moving the rollers across the surface of the borehole wall.

18. The method as claimed in claim 17, wherein moving the rollers across the surface of the borehole wall causes relative movement between the array of rollers and the borehole wall, and wherein the relative movement comprises movement of the array of rollers along the borehole axis and/or rotation of the array about the borehole axis.

19. An apparatus for modifying the wall surface of a borehole drilled through an underground formation, comprising:

a tool body conveyable in the borehole via a conveyance system;

an array of rollers arranged with their axes parallel to the borehole axis so as to be urged against and moved across the borehole wall;

a plurality of arms each extending from the tool body, wherein each roller is mounted to a corresponding one of the plurality of arms; and an electrical control system operable to transmit power to one or more of the plurality of the arms to control an opening of the arms towards the wall surface of a borehole.

20. Apparatus as claimed in claim 19, wherein means are provided to rotate the array of rollers around the tool axis so as to provide full circumferential coverage.

21. Apparatus as claimed in claim 20, wherein the means comprise means for rotating the tool body with the array or rollers fixed thereto via the plurality of arms.

22. Apparatus as claimed in claim 20, wherein the means comprise means for rotating the plurality of arms and array of rollers relative to the tool body.

* * * * *